US007124904B1

(12) United States Patent
Miceli et al.

(10) Patent No.: US 7,124,904 B1
(45) **Date of Patent: *Oct. 24, 2006**

(54) REVERSIBLE CHILD RESISTANT CLOSURE

(75) Inventors: David Miceli, Spencer, TN (US); Joseph Miceli, Spencer, TN (US)

(73) Assignee: Tri State Distribution, Inc., Spencer, TN (US)

( * ) Notice: Subject to any disclaimer, the term of this patent is extended or adjusted under 35 U.S.C. 154(b) by 122 days.

This patent is subject to a terminal disclaimer.

(21) Appl. No.: 10/814,085

(22) Filed: Mar. 31, 2004

Related U.S. Application Data

(63) Continuation-in-part of application No. 09/938,292, filed on Aug. 24, 2001, now Pat. No. 6,802,427.

(60) Provisional application No. 60/227,844, filed on Aug. 25, 2000.

(51) Int. Cl.
*B65D 41/02* (2006.01)

(52) U.S. Cl. ..... 215/228; 215/204; 215/220; 215/230

(58) Field of Classification Search ..... 215/228, 215/221, 217, 204, 220, 219, 230, 334; 206/495.5
See application file for complete search history.

(56) References Cited

U.S. PATENT DOCUMENTS

| | | | | |
|---|---|---|---|---|
| 942,141 | A | 12/1909 | Hoffman | |
| 1,435,723 | A | 11/1922 | Mayer | |
| 2,054,031 | A * | 9/1936 | Conner et al. | 215/252 |
| 3,344,942 | A | 10/1967 | Hedgewick | |
| 3,435,975 | A | 4/1969 | Weigand | |
| 3,557,985 | A | 1/1971 | St. Denis | |
| 3,612,324 | A | 10/1971 | Malick | |
| 3,795,338 | A * | 3/1974 | Swartzbaugh et al. | 215/219 |
| 3,865,267 | A | 2/1975 | Morris | |
| 3,951,289 | A | 4/1976 | Landen | |
| 4,223,793 | A * | 9/1980 | Patton | 215/220 |
| 4,387,821 | A | 6/1983 | Geiger | |
| 4,452,364 | A | 6/1984 | Kay | |
| 4,469,233 | A * | 9/1984 | Wegscheid | 215/230 |
| 4,526,281 | A | 7/1985 | Herr | |
| 4,694,968 | A | 9/1987 | Proctor et al. | |

(Continued)

FOREIGN PATENT DOCUMENTS

EP 0 792 818 A1 9/1997

(Continued)

OTHER PUBLICATIONS

International Search Report PCT/US01/06103 dated Sep. 26, 2001.

*Primary Examiner*—Robin A. Hylton
(74) *Attorney, Agent, or Firm*—Waddey & Patterson, P.C.; Phillip E. Walker; I. C. Waddey, Jr.

(57) ABSTRACT

A reversible child resistant closure system including a closure and container a container having a neck portion, an engaging means and an axis extending therethrough about which the closure is rotatable. The closure has a child resistant mode when applied to the container in a first child resistant position and has a non-child resistant mode when applied to the container in a second non-child resistant position. The closure includes an outer cap and an inner cap. The inner cap is coaxially positioned and nested within the outer cap and is axially movable between the first child resistant engaging means and the bottom edge of the outer cap such that the plurality of angular abutment surfaces of the inner cap engage the series of angular abutments of the outer cap upon rotation of the outer cap to rotates the inner cap in a closing direction.

13 Claims, 5 Drawing Sheets

U.S. PATENT DOCUMENTS

| | | | | | |
|---|---|---|---|---|---|
| 4,823,967 | A | | 4/1989 | Thompson | |
| 5,092,477 | A | * | 3/1992 | Johnson et al. | 215/230 |
| 5,115,929 | A | * | 5/1992 | Buono | 215/220 |
| 5,190,178 | A | | 3/1993 | Luch | |
| 5,449,078 | A | * | 9/1995 | Akers | 215/222 |
| 5,464,110 | A | | 11/1995 | Heyworth | |
| 5,497,879 | A | * | 3/1996 | Kao | 206/389 |
| 5,579,934 | A | | 12/1996 | Buono | |
| 5,711,442 | A | | 1/1998 | Kusz | |
| 5,769,252 | A | * | 6/1998 | Volpe | 215/201 |
| 5,819,968 | A | | 10/1998 | Jones | |
| 5,836,465 | A | | 11/1998 | King | |
| 5,865,330 | A | | 2/1999 | Buono | |
| 5,899,348 | A | | 5/1999 | Konefal et al. | |
| 5,924,588 | A | * | 7/1999 | Brennan | 206/223 |
| 5,927,532 | A | | 7/1999 | Traub | |
| 5,934,492 | A | | 8/1999 | Jones | |
| 6,082,565 | A | | 7/2000 | Harrold | |
| 6,446,823 | B1 | * | 9/2002 | Miceli et al. | 215/228 |
| 6,523,709 | B1 | * | 2/2003 | Miceli et al. | 215/228 |
| 6,802,427 | B1 | * | 10/2004 | Miceli et al. | 215/228 |
| 2004/0226907 | A1 | * | 11/2004 | Miceli et al. | 215/217 |

FOREIGN PATENT DOCUMENTS

| | | |
|---|---|---|
| WO | WO 0164529 A2 | 9/2001 |

* cited by examiner

REVERSIBLE CHILD RESISTANT CLOSURE

CROSS-REFERENCES TO RELATED APPLICATIONS

This application is a continuation-in-part application of, and claims benefit to, U.S. patent application Ser. No. 09/938,292 filed Aug. 24, 2001, now U.S. Pat. No. 6,802,427 entitled "Reversible Child Resistant Closure", which claims priority to U.S. Provisional patent application Ser. No. 60/227,844 filed Aug. 25, 2000, entitled "Reversible Child Resistant Closure", both of which are hereby incorporated by reference in their entirety.

A portion of the disclosure of this patent document contains material that is subject to copyright protection. The copyright owner has no objection to the facsimile reproduction by anyone of the patent document or the patent disclosure, as it appears in the U.S. Patent and Trademark Office patent file or records, but otherwise reserves all copyright rights whatsoever.

FIELD OF THE INVENTION

The present invention relates a closure that may be applied to a vial or other container in either a child resistant configuration or a non-child configuration. In its child resistant configuration the closure provides an obstacle to children being able to remove the closure from the container, however, in its non-child resistant configuration the closure allows for ready removal of the closure from the container. The present invention also provides a closure and container assembly.

BACKGROUND OF THE INVENTION

There are many varying types of child resistant closure systems disclosed in the art. An example of a particular type of child resistant closure system is disclosed in U.S. Pat. No. 5,449,078, which relates to a combination of a container and safety cap. While many child resistant caps effectively provide protection against the danger of small children being able to remove potentially harmful pills from vials or other containers, they also provide a problem for a considerable portion of the adult population that require medication, however, lack the manual dexterity or strength to remove the child resistant cap. This is of a particular concern to the elderly population or people suffering from arthritis and other debilitating diseases.

This particular problem has been addressed by the development of closure systems having a child resistant mode and a non-child resistant mode such that, in the non-child resistant mode, the closure are more easily opened by adults. An example of such a closure is disclosed in U.S. Pat. No. 5,579,934 (the '934 patent) which is herein incorporated by reference. The '934 patent discloses a container closure that is selectively manipulable between a configuration which resists opening by children and a configuration which may be easily opened without special manipulation of the closure. Specifically, the closure is manipulated into its non-child resistant mode by "pressing down" on the central portion of the top surface of the closure. Although the aforementioned closure effectively provides protection against the danger of small children being able to remove it from vials or other containers, a certain portion of the adult population lack the manual dexterity or strength to "press down" the central portion of the top surface of the closure so to manipulate the closure from its child resistant configuration to its non-child resistant configuration. This manipulation or "pushing down" also represents a problem for people with long fingernails. Other reversible child resistant closure have been developed to address this problem, however, making the closure easier to convert into the non-child resistant configuration increase the risk that the closures will inadvertently be converted into their non-child resistant configurations. Similarly, there is an increased risk that automated filling machines will inadvertently convert the closures into their non-child resistant configurations when applying the closure to the container.

Further, the closures of the type disclosed in the '934 patent cannot include a warning to the consumer once the closure has been converted to its non-child resistant configuration. This message is required by the Consumer Product Safety Commission ("CPSC") to alert users that the closure has been converted into the non-child resistant configuration.

Furthermore, other reversible child resistant designs that do include the CPSC consumer warning cannot be used in automated dispensing equipment due to projections on their outer surface.

In light of the foregoing, there is a need for a closure that has a child resistant mode which resists opening by children, has a non-child resistant mode which may be easily opened without special manipulation, resists inadvertent conversion from its child resistant mode to its non-child resistant mode, is capable of including the mandated CPSC warning "CAUTION NOT CHILD RESISTANT" when used in its non-child resistant mode, and can be used in automated dispensing machines so overcoming the aforementioned deficiencies of the prior art.

SUMMARY OF THE INVENTION

Accordingly, the present invention is directed to a closure that substantially obviates one or more of the problems due to limitations and disadvantages of the related art. Additional features and advantages of the invention will be set forth in the description which follows, and in part will be apparent from the description, or may be learned by practice of the invention. The objectives and other advantages of the invention will be realized and attained by the apparatus particularly pointed out in the written description and claims hereof as well as in the appended drawings.

To achieve these and other advantages and in accordance with the purpose of the invention, as embodied and broadly described, the reversible child resistant closure of the present invention for use with a container having a neck portion has an engaging means and an axis extending therethrough about which the closure is rotatable. The closure has a child resistant mode when applied to the container in a first child resistant position and has a non-child resistant mode when applied to the container in a second non-child resistant position. The closure includes an outer cap and an inner cap. The outer cap includes a first circumferential side wall that extends from a top edge to a bottom edge. This first circumferential side wall has a first inner surface with a non-child resistant engaging means for rotatable engagement with the engaging means of the container and a first child resistant engaging means axially offset from the non-child resistant engaging means comprising a series of angular abutments extending about the first inner surface. The inner cap includes a second inner surface and an outer surface. The second inner surface is provided with a second child resistant engaging means for rotateable engagement with the engaging means of the container and the outer surface is provided with a third child resistant engaging means having a plurality of angular abutment surfaces complementary to the series of angular abutments on the outer cap.

The inner cap is coaxially positioned and nested within the outer cap and is axially movable between the first child resistant means and the bottom edge of the outer cap such that the plurality of angular abutment surfaces of the inner cap engage the series of angular abutments of the outer cap upon rotation of the outer cap to rotate the inner cap in a closing direction. However, upon rotation of the outer cap to rotate the inner cap in a closing direction. However, upon rotation of the outer cap member in an opening direction in the absence of an axial force, the plurality of angular abutment surfaces of the inner cap cam over and past the series of angular abutments of the outer cap so preventing rotation of the inner cap.

In another aspect, the present invention includes a closure system being the combination of the closure of the present invention and a container.

It is to be understood that both the foregoing general description and the following detailed description are exemplary and explanatory and are intended to provide further explanation of the invention as claimed.

The accompanying drawings are included to provide a further understanding of the invention and are incorporated in and constitute part of this specification, illustrate several embodiments of the invention and together with the description serve to explain the principles of the invention.

BRIEF DESCRIPTION OF THE SEVERAL VIEWS OF THE DRAWINGS

FIG. 8 shows one possible configuration of the indicia on the inner cap.

FIG. 9 shows an alternate configuration of the indicia on the inner cap.

FIG. 10 shows an alternate configuration of the indicia on the inner cap.

DETAILED DESCRIPTION OF THE INVENTION

Figure 1A:
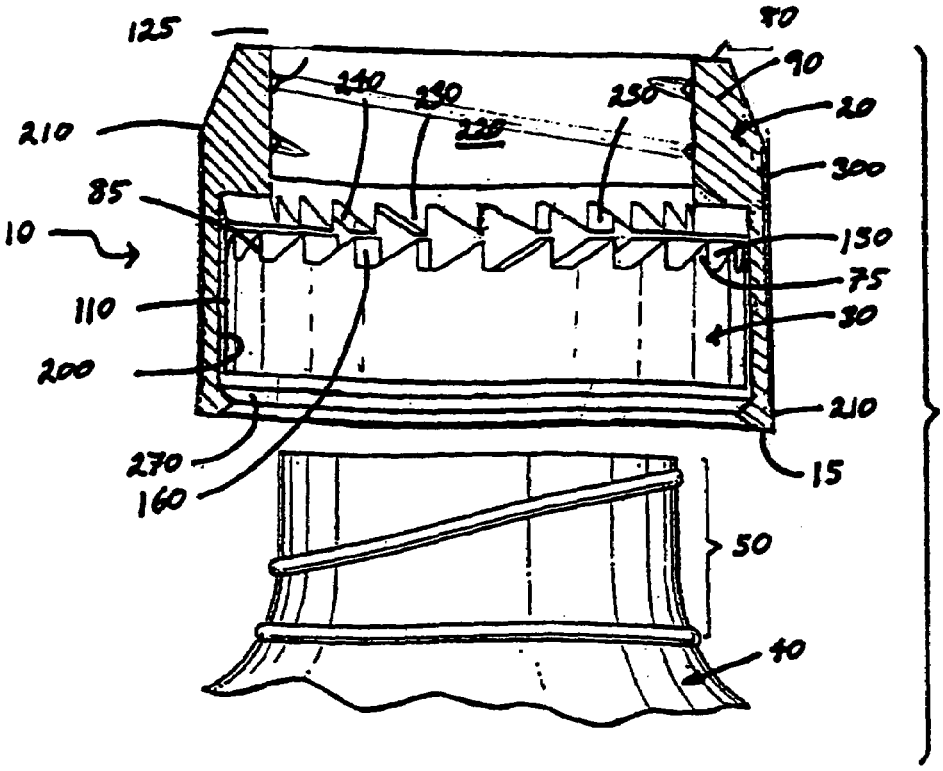
FIG. 1A is an exploded view, partly in side elevation and partly in cross section, of a child resistant container and closure combination constructed in accordance with the present invention, the closure being relatively positioned to resist opening of a container by children.
Figure 1B:
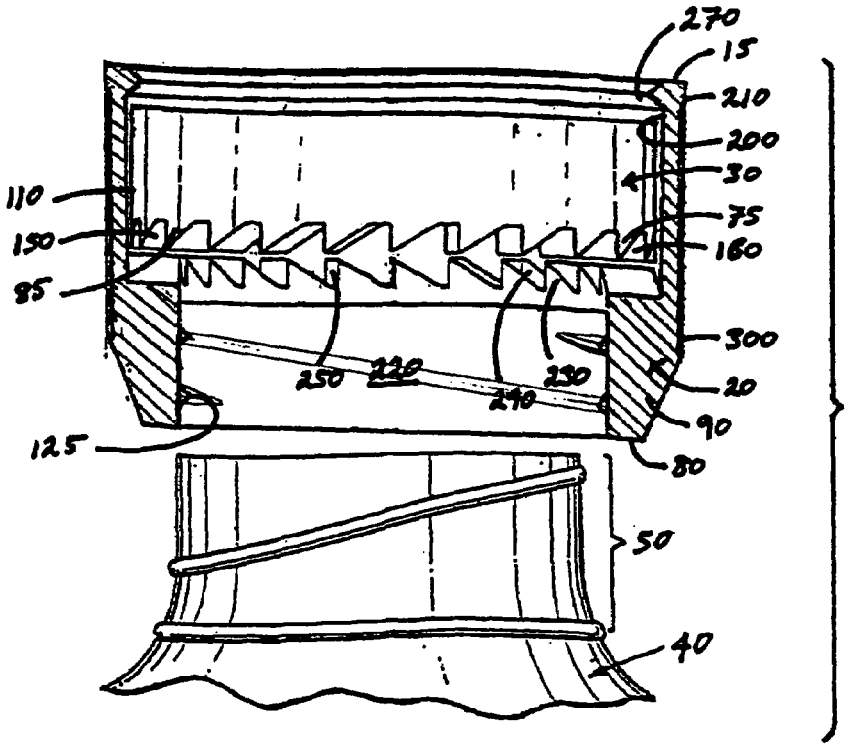
FIG. 1B is a view like FIG. 1A but the closure being relatively positioned to permit easy opening by an adult.

Referring now to the drawings of the present disclosure in which like numbers represent the same structure in the various views, FIGS. 1A and 1B show a reversible child resistant closure system in accordance with the present invention. FIG. 1A shows the closure in its child resistant mode and FIG. 1B shows the same closure in its non-child resistant mode. The closure system comprises a reversible child resistant closure 10 and a container 40. The closure 10 includes an outer cap 20 and an inner cap 30. The closure 10 is constructed for use with a container 40 having any suitable engaging means, for example, a threaded neck portion 50, and is primarily directed for use with containers which sotre and dispense pharmaceutical products and the like but may also be used with any container having a suitable engaging means, irrespective of its contents. As will be described in more detail below, the inner cap 30 is coaxially positioned and nested within the outer cap 20 such that it is movable between a child resistant engaging means of the outer cap 20, shown in the embodiment at FIGS. 1A and 1B as a series of angular teeth 230, and the bottom edge 15.

Figure 2:
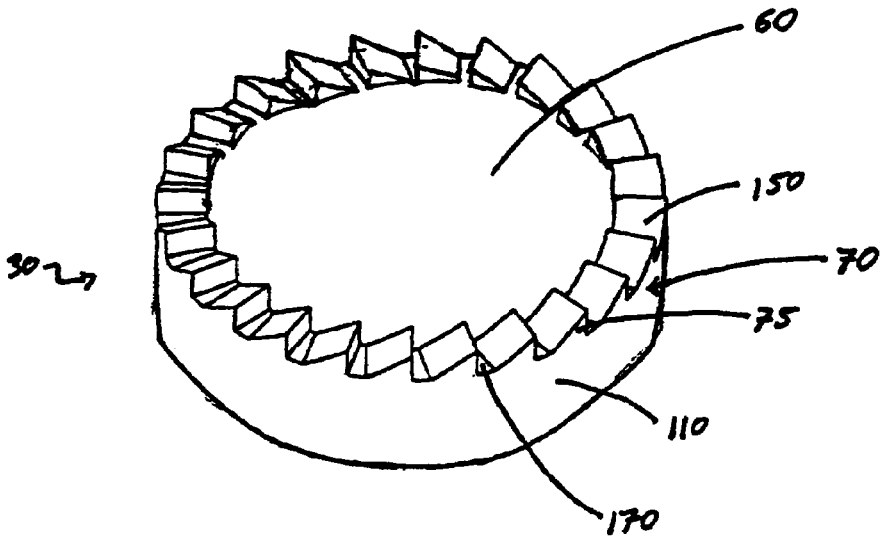
FIG. 2 is a top perspective view of the inner cap of the closure of FIGS. 1A and 1B.
Figure 3:
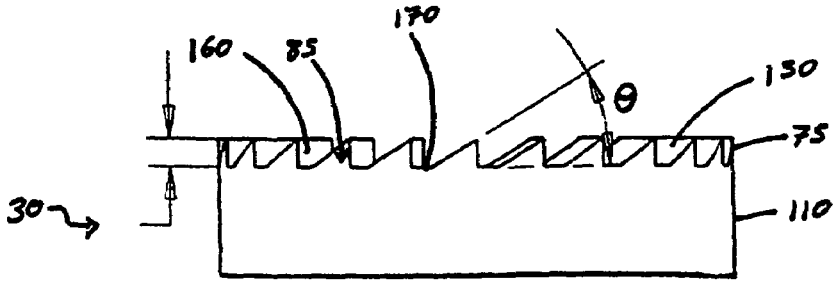
FIG. 3 is a side view of the inner cap of the closure of FIGS. 1A and 1B.
Figure 4:
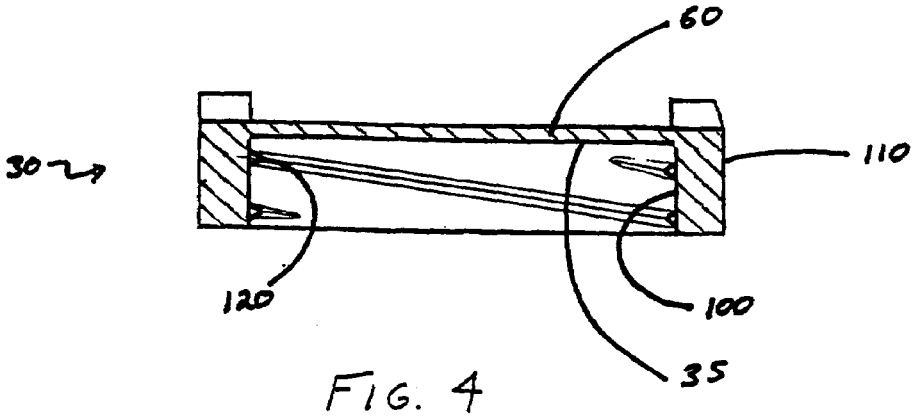
FIG. 4 is a cross sectional view of the inner cap of FIGS. 2 and 3.

As best shown in FIGS. 2, 3 and 4 the inner cap includes an upper surface 60 that has a circumferential side wall 70 extending therefrom. The side wall 70 has an inner surface 100 which includes an engaging means for rotatably engaging the engaging means of the container. Any suitable engaging means for rotatable engagement may be used. For example, the engaging means may be a thread bead for engaging the threaded exterior surface portion 50 of the container 40 shown in FIGS. 1A and 1B. Preferably, the engaging means is a single thread bead. More prefereably, as shown in FIG. 4, the engaging means is a double thread bead 120. The side wall 70 of the inner cap 30 also has an outer surface 110 and a child resistant portion comprising a series of angular abutments. As shown in FIGS. 2, 3 and 4, preferably the series of angular abutments extend upward from the side wall 70 such that the outer side 75 of each angular abutment, shown here as angular teeth 85, is about flush with and parallel to the outer surface 110 of the inner cap 30. As can best be seen from FIG. 3 each tooth 85 forming the series of angular abutments of the child resistant portion of the inner cap 30 has a first sloped surface 150 and a second substantially vertical surface 160. The first sloped surface 150 and the second substantially vertical surface 160 define an angle 0 which is preferably in the range of from about 22° to about 45°, and is more preferably about 25° to about 33°. Each tooth may abut directly with the next, or may be spaced apart by surface 170. Preferably each tooth abuts directly with the next. Any suitable numbers of teeth may be utilized, however, preferably between twenty (20) and fifty (50) teeth 85 are included. Most preferably, the inner cap 30 comprises about thirty six (36) individual teeth.

Figure 8:
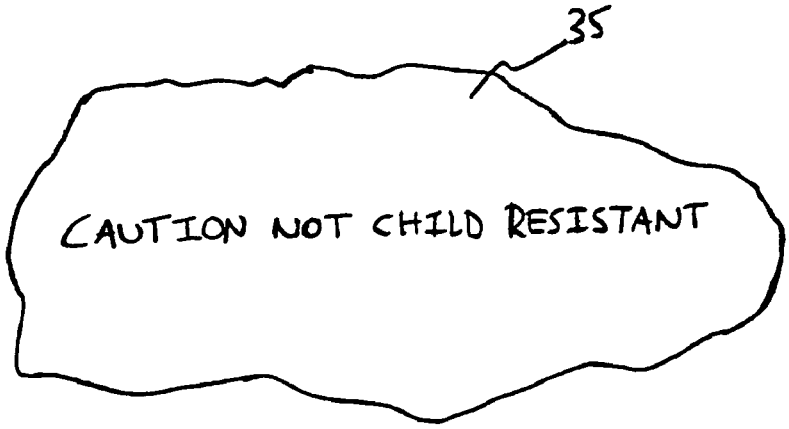
FIG. 8 is a bottom plan view, with portions broken away, of the inner cap illustrated in FIG. 4.
Figure 9:
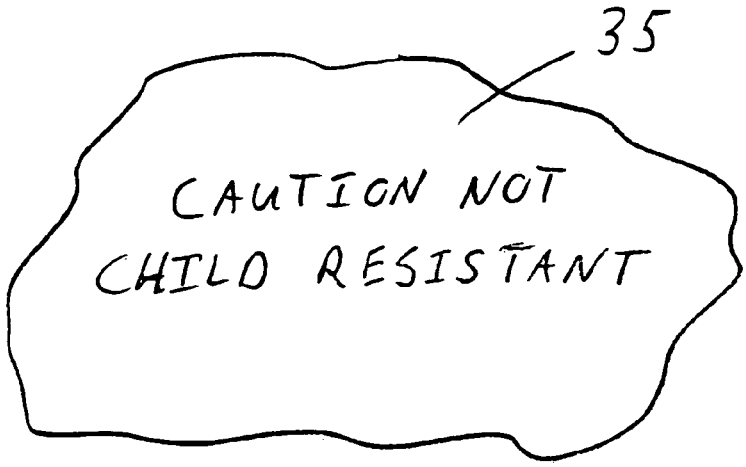
FIG. 9 is a bottom plan view, with portions broken away, of the inner cap illustrated in FIG. 4.
Figure 10:
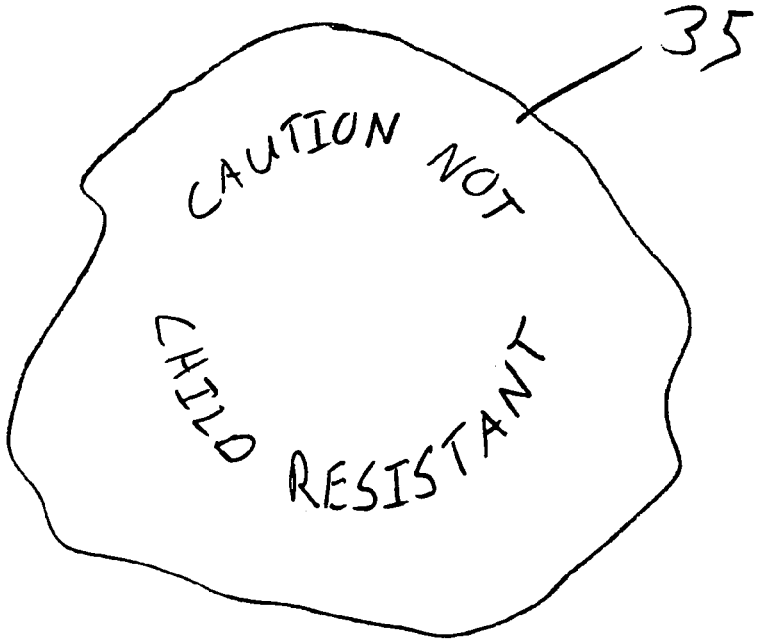
FIG. 10 is a bottom plan view, with portions broken away, of the inner cap illustrated in FIG. 4.

In a preferred embodiment, as best shown in FIG. 4, the upper surface 60 of the inner cap 30 has an inner surface 35. To comply with CPSC requirements, the inner surface 35 includes a warning, for example, "CAUTION NOT CHILD RESISTANT." A liner, in the shape of a disc may also be included such that it fits inside the inner cap adjacent and parallel to the inner surface 35. If a liner is used, then the visible side of the liner may also include a warning, for example, "CAUTION NOT CHILD RESISTANT." Possible examples of the spatial, or geometrical, configurations of one example of the indicia are shown in FIGS. 8–10. The indicia used to relay the warning as well as configuration of the indicia that comprise the warning can vary and still maintain the inventive scope of this disclosure.

Figure 5:
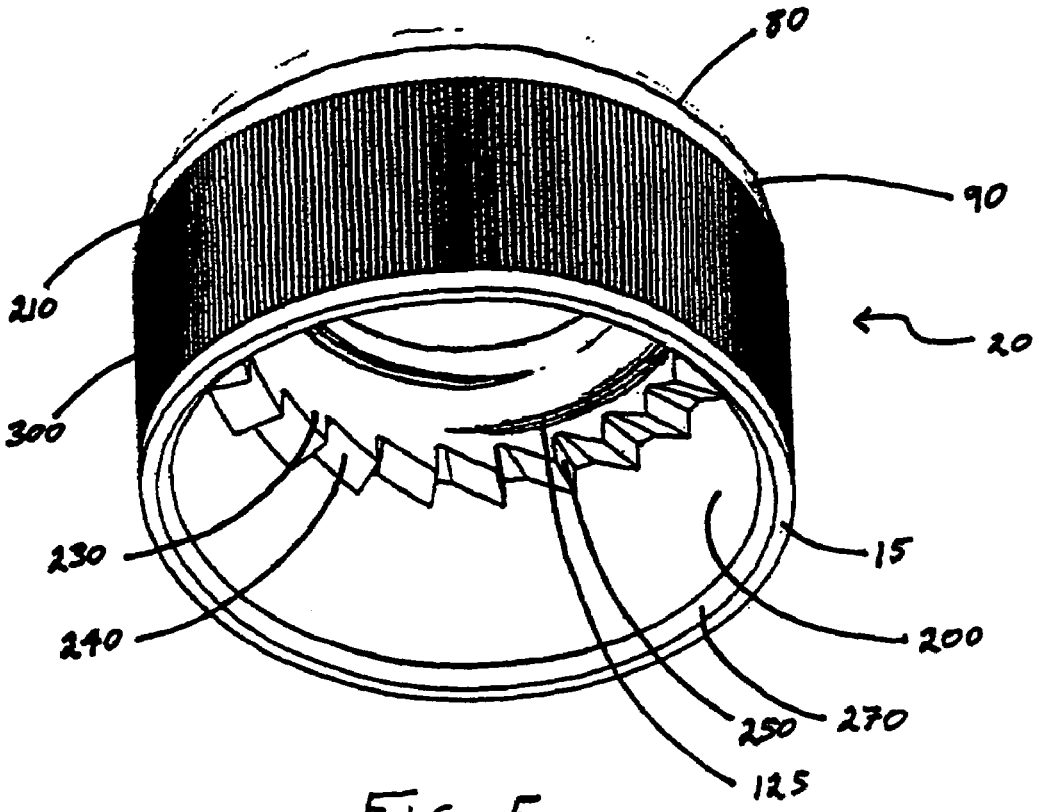
FIG. 5 is a bottom perspective view of the outer cap of the closure of FIGS. 1A and 1B.
Figure 6:
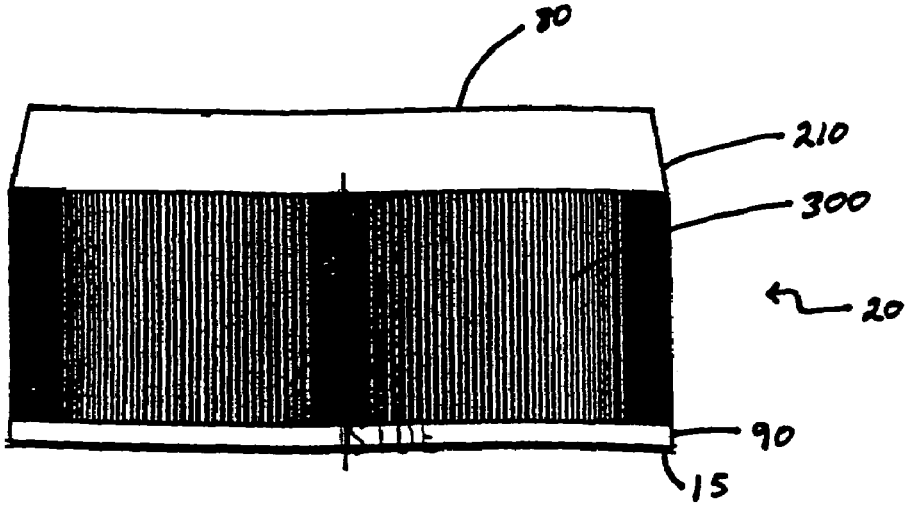
FIG. 6 is a side view of the outer cap of the closure of FIGS. 1A and 1B.

Referring now to FIG. 5, the outer cap 20 has a circumferential side wall 90 extending from a top edge 80 to a bottom edge 15 and has an inner surface 200 and an outer surface 210. The outer surface 210 may further compromise a gripping means to facilitate rotation of the closure 10 to aid both putting the closure on the container 40 and subsequent removal. Any suitable gripping means may be utilized. In a preferred embodiment, knerlments 300 are diposed about the outer surface 210 of the outer cap 20. Preferably, the top edge 80 surrounds a central opening 220 which can be best seen in FIG. 7.

Figure 7:
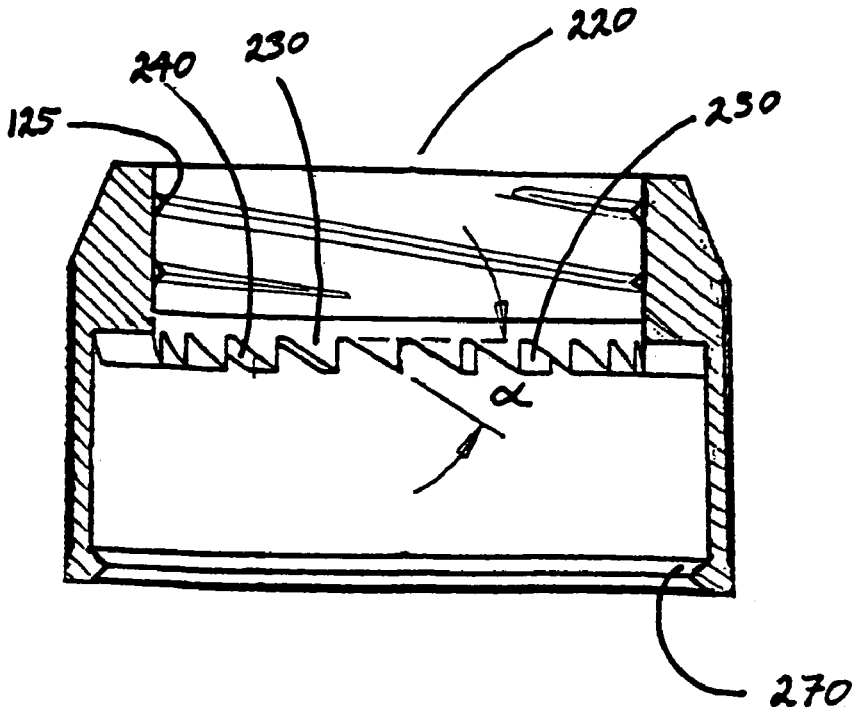
FIG. 7 is a cross sectional side view of the outer cap of FIGS. 5 and 6.

The inner surface 200 of the outer 20 is provided with a child resistant region which includes a plurality of angular abutment surfaces which are of size, position and orientation to complement the series of angular abutments extending from the outer surface of the child resistant portion of the side wall 70 of the inner cap 30. As shown in FIG. 7, these angular abutments are preferably in the form of angular teeth 230, each tooth having a first sloped surface 240 and a second substantially vertical surface 250. The sloped first surface 240 and the substantially vertical surface 250 define an angle $\alpha$ preferably ranging from about 22° to about 45°, and more preferably about 25° to about 33°. The inner cap 30 may have any suitable numbers of such sloped first surfaces 240.

In a preferred embodiment show in the FIGS. The ratio of the teeth of the inner cap to the angular teeth 230 of the outer cap is one to one. However, any other integral ratio may be used, for example, two to one, three to one, or the like. In a more preferred embodiment, thirty six (36) sloped surfaces 240 are used which compliment the thirty six (36) teeth 85 of the preferred inner cap 20.

The angular abutment surfaces on the outer cap 20 are angled in the same direction as the series of angular abutments extending from the outer surface of the side wall 70 of the inner cap 30. Further, angles $\theta$ and $\alpha$ defined by the abutments of the outer cap 20 and the inner cap 30 respectively are preferably close to each other. Thus, when the closure 10 is in its child resistant mode as shown in FIG. 1A, and when the outer cap 20 is rotated in the opening direction, the abutment surfaces of the outer cap 20 will ratchet or ride over the angular abutment surfaces of the inner cap 30, thereby permitting rotation of the outer cap 20 relative to the inner cap 30. This, however, can be overcome by the application of the axial force on the outer cap 20 toward the inner cap 30 in combination with the rotation of the outer cap 20 in the operating direction, which prevents the ratcheting of the angular abutment surfaces of the outer cap 20 over the angular abutment surfaces of the inner cap 30, which in turn causes the inner cap 30 to rotate with the outer cap 20 in the opening direction.

The inner surface 200 of the outer cap 20 is also provided with a non-child resistant engaging means for rotatably engaging the engaging means of the container 40. Any suitable engaging means may be used that is complementary to the engaging means of the container 40. For example, as shown in FIG. 7, the non-child resistant engaging means may be a thread bead for engaging the threaded exterior surface portion 50 of the container 40. Preferably, the engaging means is a single thread bead. More preferably, as shown in FIG. 7, the engaging means in a double thread bead 125.

Thus, to convert the closure 10 from its child resistant mode to its non-child resistant mode simply requires the user to remove the outer cap 20 from the container 40 and inverting the closure 10 and simply rotatably attach the closure 10 to the container 40 by rotating the closure 10 in a closing direction which is preferably clockwise. The inner surface 200 may also include a lip 270 which prevents the inner cap 30 from moving past the child resistant region and out of nesting relation with the out cap 20.

In order to convert the child resistant closure 10 from its non-child resistant mode as shown in FIG. 1B to its child resistant mode as shown in FIG. 1A, the user simply removes the closure 10 from the container 40 by rotating the closure in an opening direction, preferably counter-clockwise, and then inverting the closure 10 and then simply rotatably attaching the closure 10 to the container 40 by rotating the closure 10 in a closing direction, which is preferably clockwise.

In order to utlize a preferred embodiment of the closure 10 when in a child resistant mode, as shown in FIG. 1A, the closure 10 is first placed on the threaded portion 50 of the container 40 by threadedly engaging thread 120 on inner cap 30 with the threaded portion 50. A rotative force turns the outer cap 20 in the closing direction, here shown to be clockwise. The substantially vertical surfaces 160 of the teeth on the inner cap 30 and sloped first surfaces 240 on the outer cap 20 interengage to cause the inner and outer caps to turn together, e.g. to cause the inner cap 30 to remain rotationally stationary relative to the outer cap 20, to close the container. Upon closing the container 40 further rotation of the closure 10 in the closing direction is prevented. Rotation of the closure 10 in the opposite direction will cause the sloped first surfaces 240 of the outer cap 20 to ratchet or ride over the first sloped first surfaces 150 of the teeth of the inner cap 30. That is to say, the mere turning of the outer cap 20 in the opening direction will not rotate inner cap 30 in an opening direction because there is no transmission of torque from the outer to the inner cap as the sloped first surfaces 240 ride over and slide by the sloped first surfaces 150.

In order to open the closed container 40 with the closure 10 in its child resistant mode, the user must utilize both a rotative and axial force. It is the axial force that prevents the sloped first surfaces 240 of the outer cap 20 from ratcheting or riding up and over sloped first surfaces 150 of the inner cap 30. Thus, when the outer cap 20 is rotated in an opening direction, here counterclockwise, with the use of both rotational and axial force, the sloped first surfaces 240 of the outer cap 20 are prevented from ratcheting over sloped first surfaces 150 but instead engage one another to transmit torque between sloped first surfaces 240 and sloped first surfaces 150 to thereby rotate the inner cap 30 causing it to disengage from the threaded portion 50 of the container 40. Accordingly, the closure 10 is disengaged from the container 40 and the container is open.

This is presently preferred form for effecting the child resistant feature of the present invention. Of course, other means for drivingly connecting the inner and outer cap members relative to one another may be employed without departing from this invention. See for example, U.S. Pat. No. 5,579,934 (herein incorporated by reference) for suitable alternatives.

It is to be understood that the reversible closure device provided in accordance with the present invention can be formed of any suitable material such as plastic or metal or a combination of materials and the like and that the invention is not intended to be limited by the material form witch the devices are formed.

It will be apparent to those skilled in the art that various modifications and variations can be made to the closure of the present invention without departing from the spirit or scope of the invention. Thus, it is intended that the present invention cover the modifications and variations of this invention provided they come within the scope of the appended claims and their equivalents. Accordingly, the invention is not limited by the embodiments described above which are presented as examples only but can be modified in various ways within the scope of protection defined by the appended patent claims.

What is claimed is:

1. A reversible child resistant closure for use with a container, the closure having a child resistant mode when applied to the container in a first child resistant position and having a non-child resistant mode when applied to the container in a second non-child resistant position, the closure comprising:

an outer cap comprising a first circumferential side wall extending from a top edge to a bottom edge, wherein the first circumferential side wall has a first inner surface with a non-child resistant engaging means for rotatable engagement with the engaging means of the container and a first child resistant engaging means axially offset from the non-child resistant engaging means comprising a series of angular abutments extending about the first inner surface;

an inner cap comprising a second circumferential side wall extending axially from an upper surface, wherein the second circumferential side wall has a second inner surface and an outer surface, the second inner surface provided with a second child resistant engaging means for rotatable engagement with the engaging means of the container and the outer surface provided with a third child resistant engaging means having a plurality of angular abutment surfaces complementary to the series of angular abutments on the outer cap;

wherein the inner cap is coaxially positioned and nested within the outer cap and axially movable between the first child resistant engaging means of the outer cap and the bottom edge of the outer cap such that the plurality of angular abutment surfaces of the inner cap engage the series of angular abutments of the outer cap upon rotation of the outer cap to rotate the inner cap in a closing direction and in the absence of an axial force, cam over and past the series of angular abutments of the outer cap upon rotation of the outer cap member in an opening direction to prevent rotation of the inner cap; and wherein the upper surface of the inner cap comprises an inner surface on which is marked a warning.

2. The closure of claim 1, wherein the outer cap further comprises grips having a plurality of knurlmentes disposed about an outer surface of the outer cap.

3. The closure of claim 1, wherein the top edge of the outer cap surrounds a central opening to expose the inner cap.

4. The closure of claim 1, wherein the closure further comprises a liner adjacent an inner surface of the upper surface of the inner cap.

5. The closure of claim 1, wherein the angular abutments of the plurality of angular abutment surfaces of the outer cap comprise a first sloped side and a second vertical side, wherein the first sloped side and second vertical side define a first angle in a range of about 22 degrees to about 45 degrees.

6. The closure of claim 5, wherein the first angle is about 25 degrees to about 33 degrees.

7. The closure of claim 5, wherein the angular abutments of the series of angular abutments of the inner cap comprise a first sloped side and a second vertical side, wherein the first sloped side and second vertical side define a second angle in a range of about 22 degrees to about 45 degrees.

8. The closure of claim 7, wherein the first angle is substantially complementary but not equal to the second angle.

9. The closure of claim 1, wherein the angular abutments of the series of angular abutments of the inner cap comprise a first sloped side and a second vertical side, wherein the first sloped side and second vertical side define a second angle in a range of about 22 degrees to about 45 degrees.

10. The closure of claim 9, wherein the second angle is about 25 degrees to about 33 degrees.

11. The closure of claim 1, wherein the first inner surface of the outer cap further comprises a lip positioned between the first child resistant engaging means and the bottom edge to define a limit of movement for the inner cap.

12. The closure of claim 1, wherein the warning comprises the words CAUTION NOT CHILD RESISTANT.

13. A reversible child resistant closure system comprising the closure claimed in claim 1 and a container having an engaging means.

* * * * *